US007690539B1

(12) United States Patent
Tudor et al.

(10) Patent No.: US 7,690,539 B1
(45) Date of Patent: Apr. 6, 2010

(54) VISCOUS MATERIAL DISPENSE SYSTEM

(76) Inventors: Thomas R. Tudor, 8174 Melvin, Westland, MI (US) 48185; William C. Paetow, II, 11445 McGregor, Pinckney, MI (US) 48169

( * ) Notice: Subject to any disclaimer, the term of this patent is extended or adjusted under 35 U.S.C. 154(b) by 2092 days.

(21) Appl. No.: 10/023,333

(22) Filed: Dec. 12, 2001

Related U.S. Application Data

(60) Division of application No. 09/542,651, filed on Apr. 4, 2000, now Pat. No. 6,364,218, which is a continuation of application No. 09/138,279, filed on Aug. 21, 1998, now Pat. No. 6,062,492.

(60) Provisional application No. 60/085,642, filed on May 15, 1998.

(51) Int. Cl.
*B65D 83/00* (2006.01)

(52) U.S. Cl. ..... 222/459; 222/145.6

(58) Field of Classification Search ..... 222/145.6, 222/459; 366/336, 342
See application file for complete search history.

(56) References Cited

U.S. PATENT DOCUMENTS

| | | | | |
|---|---|---|---|---|
| 1,438,239 | A | 12/1922 | Heinrich | 239/290 |
| 2,297,239 | A | 9/1942 | Neugebauer et. al. | 60/35.6 |
| 2,626,424 | A | 1/1953 | Hawthorne, Jr. | 65/466 |
| 2,805,006 | A | 9/1957 | Henchert | 222/566 |
| 2,808,972 | A | 10/1957 | Flugge et al. | 222/566 |
| 2,813,664 | A | 11/1957 | Punte | 222/566 |
| 2,920,799 | A | 1/1960 | Binder | 222/541 |
| 3,138,821 | A | 6/1964 | Macciocchi et al. | 15/595 |
| 3,152,923 | A | 10/1964 | Marshall et al. | 118/2 |
| 3,157,312 | A | 11/1964 | Kitterman | 222/1 |
| 3,179,299 | A | 4/1965 | Allegraud et al. | 222/207 |

(Continued)

OTHER PUBLICATIONS

"The American Heritage Dictionary", Houghton Mifflin, copyright 1982, p. 811.*

(Continued)

*Primary Examiner*—Robert M Fetsuga
(74) *Attorney, Agent, or Firm*—Young Basile

(57) ABSTRACT

A viscous material dispense system including a dispense valve having an outlet, a mix tube secured at an upper end thereof to the outlet of the dispense valve, a mixer shroud positioned telescopically over the mix tube and including a conical lower end, and an air shroud fitted telescopically over the lower end of the mixer shroud and defining a conical surface positioned in confronting relation to the conical tip portion of the mixer shroud. The air shroud and the lower end of the mixer shroud coact to define a plurality of circumferentially spaced axially extending flutes extending downwardly between the outer surface of the mixer shroud and the inner surface of the air shroud and a plurality of circumferentially spaced radially extending flutes defined between the conical tip portion of the mixer shroud and the conical surface of the air shroud. Each radial flute communicates with a respective axial flute so that air enters proximate the upper end of the air shroud, moves downwardly between the air shroud and the mixer shroud as a series of axially spaced air streams, and thereafter moves radially inwardly between the lower end of the mixer shroud and the air shroud as a plurality of radially inwardly moving air streams which impinge upon a material bead exiting from the lower end of the mix tube to impart a swirling movement to the bead.

2 Claims, 4 Drawing Sheets

U.S. PATENT DOCUMENTS

| | | | | | |
|---|---|---|---|---|---|
| 3,692,241 | A | | 9/1972 | Walberg | 239/15 |
| 3,702,175 | A | | 11/1972 | Watkins | 239/590 X |
| 3,941,355 | A | * | 3/1976 | Simpson | 222/145.6 X |
| 4,185,981 | A | | 1/1980 | Ohsato et al. | 65/5 |
| 4,219,157 | A | | 8/1980 | Binoche | 239/296 |
| 4,334,637 | A | | 6/1982 | Baker et al. | 239/600 X |
| 4,370,062 | A | | 1/1983 | Moody | 239/432 X |
| 4,407,647 | A | | 10/1983 | Denzler | 425/208 |
| 4,773,564 | A | | 9/1988 | Wallner | 222/145 |
| 4,785,996 | A | | 11/1988 | Ziecker et al. | 239/298 |
| 4,830,280 | A | | 5/1989 | Yankoff | 239/590 X |
| RE33,481 | E | | 12/1990 | Ziecker et al. | 239/298 |
| 4,983,109 | A | | 1/1991 | Miller et al. | 239/298 X |
| 4,995,540 | A | | 2/1991 | Colin et al. | 222/132 |
| 5,026,194 | A | | 6/1991 | Lewis | 222/567 X |
| 5,072,862 | A | | 12/1991 | Keller | 222/496 |
| 5,092,492 | A | | 3/1992 | Centea | 222/137 |
| 5,141,155 | A | | 8/1992 | Jacobsen | 239/591 X |
| 5,169,070 | A | | 12/1992 | Mattson | 239/290 |
| 5,180,082 | A | | 1/1993 | Cherfane | 222/145 |
| 5,228,599 | A | | 7/1993 | Keller | 222/137 |
| 5,238,190 | A | | 8/1993 | Herke | 239/298 |
| 5,263,614 | A | | 11/1993 | Jacobsen et al. | 222/137 |
| 5,383,581 | A | | 1/1995 | LeMarbe et al. | 222/459 |
| 5,397,180 | A | * | 3/1995 | Miller | 366/338 |
| 5,478,150 | A | * | 12/1995 | Keller et al. | 366/336 |
| D366,051 | S | | 1/1996 | Lewis et al. | 222/129.1 X |
| 5,486,676 | A | | 1/1996 | Aleshin | 239/290 X |
| 5,498,078 | A | | 3/1996 | Keller | 222/145.6 X |
| 5,609,271 | A | | 3/1997 | Keller et al. | 222/145.6 |
| 6,138,872 | A | | 10/2000 | Brennan et al. | 236/590 X |

OTHER PUBLICATIONS

ConPro Tec, Inc. Salem, NH pamphlet Statomix-Motionless Mixers, Sep. 1993, 8 pgs.

Brochure "SEE-FLO" Meter Mix Dispense Systems for adhesives and sealants; Sealant Equpment & Engineering, Inc.; copyright 1996, 14 pgs.

* cited by examiner

FIG-4
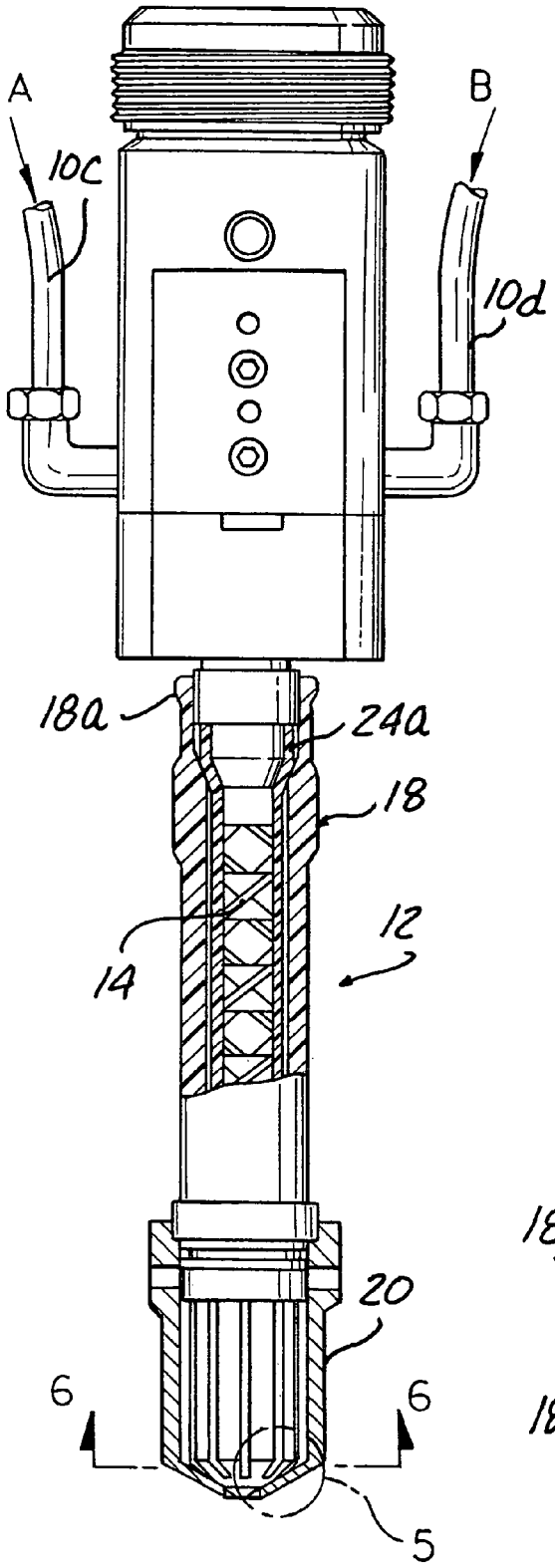
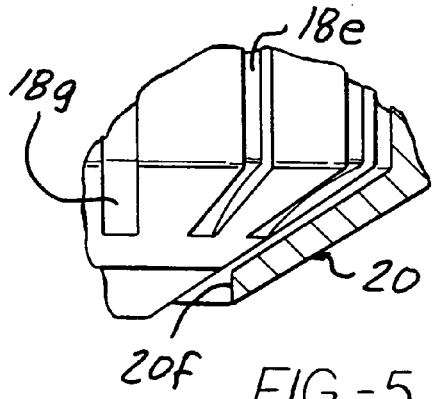
FIG-5
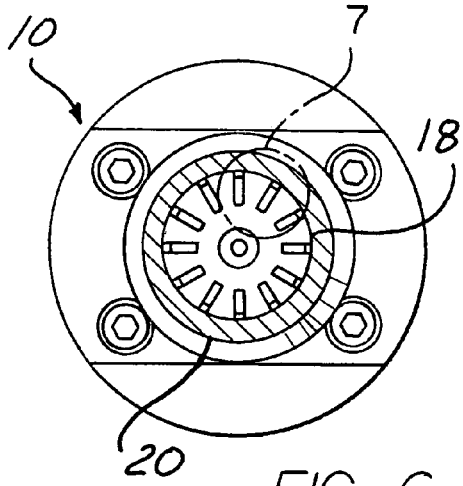
FIG-6
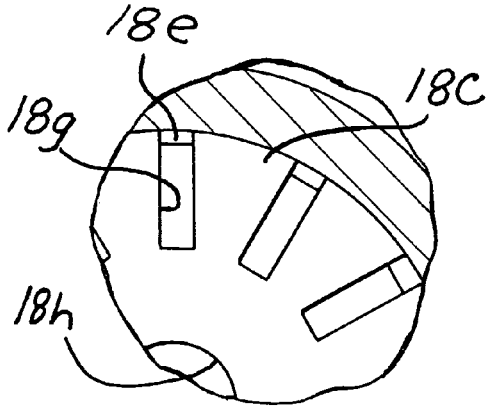
FIG-7

VISCOUS MATERIAL DISPENSE SYSTEM

RELATED APPLICATIONS

This application is a divisional of prior application Ser. No. 09/542,651 filed on Apr. 4, 2000, U.S. Pat. No. 6,364,218, which was a continua ion of prior application Ser. No. 09/138,279 filed on Aug. 21, 1998, now U.S. Pat. No. 6,062,492 which was a continuation of provisional application No. 60/085,642 filed on May 15, 1998.

BACKGROUND OF THE INVENTION

This invention relates to viscous material dispense systems and more particularly to a viscous material dispense system of the type utilizing a nozzle assembly to discharge a material bead in a controlled manner.

When designing a nozzle assembly for discharge of a material bead it is important to be able to precisely control the shape or "profile" of the bead as well as the movement aspect of the bead as it exits the nozzle. It has been proposed to direct a stream of air at the beaded material as it exits the nozzle assembly to attenuate and shape the bead, and, in fact, a multitude of nozzle assembly structures have been designed and utilized including means for directing a stream of air at the exiting bead. However, all of the prior art nozzle assembly air stream designs have either embodied a very complicated and expensive construction, and/or have not been effective to precisely shape the bead and/or have not been effective to impart the desired movement aspect to the bead as it exits the nozzle assembly.

SUMMARY OF THE INVENTION

This invention is directed to the provision of an improved viscous material dispense system.

More particularly this invention is directed to the provision of a viscous material dispense system employing a nozzle assembly having means to simply and effectively direct a stream of air against an exiting bead.

The viscous material dispense system of the invention comprises a material source having an outlet; a nozzle assembly including a tubular nozzle member having one end secured to the source outlet, another, free end defining a nozzle tip portion having a conical nozzle surface, and an axially extending main body tubular portion interconnecting the one end and the nozzle tip portion; and a tubular air shroud including a main body portion positioned telescopically over the main body portion of the tubular nozzle member and a tip portion. The main body portion of the tubular air shroud coacts with the main body portion of the tubular nozzle member to define an annular axially extending air passage therebetween and an air inlet communicating with the passage, and the tip portion of the tubular air shroud is positioned proximate the tip portion of the nozzle member and defines a conical nozzle surface coacting with the conical nozzle surface of the nozzle member tip portion to define a conical air passage therebetween communicating with the annular axially extending air passage and opening in surrounding relation to the nozzle tip portion of the nozzle member. With this arrangement, air is introduced at the air inlet and flows as an annular curtain through the axially extending air passage and thereafter flows as a conical curtain through the conical air passage to impinge on a bead of viscous material exiting the nozzle assembly. This arrangement provides a simple and inexpensive means of precisely controlling the profile of the bead.

According to further feature of the invention, the annular axially extending air passage comprises a plurality of circumferentially spaced axially extending flutes, and the conical air passage comprises a plurality of circumferentially spaced radially extending flutes each communicating at one end thereof with a respective axially extending flute. With this arrangement the bead is not only attenuated and shaped by the air stream but the air stream further acts to impart a swirl or spiral movement aspect to the bead. An attenuated, spiraled bead provides a compact spiral pattern which is desirable in many bead application scenarios.

According to a further feature of the invention, the axially extending flutes are defined by axially extending grooves in an outer surface of the main body portion of the nozzle member and the radially extending flutes are defined by radially extending grooves in the conical surface of the tip portion of the nozzle member. This arrangement provides a simple and effective means of providing the desired axial and radial flutes.

According to further feature of the invention, the air shroud is axially shorter than the nozzle member and fits as a cap over the conical tip portion of the nozzle member. This arrangement simplifies the structure of the air shroud and simplifies its positioning over the nozzle member.

According to further feature of the invention, the nozzle assembly further includes a mix tube having one end secured to the source outlet and another free end defining a conical nozzle tip portion, and the tubular nozzle member is positioned telescopically over the mix tube in shrouding relation with its nozzle tip portion proximate the conical nozzle tip portion of the mix tube. This arrangement allows the system to be readily utilized in dispensing a two part material mix.

According to further feature of the invention, the nozzle assembly further includes a tubular conical insert positioned in the mix tube proximate the nozzle tip portion thereof and operative to define the size and configuration of the bead. This arrangement allows the bead size to be readily modified simply by changing the conical insert.

According to further feature of the invention, the nozzle assembly further includes a tubular dispenser tip positioned in the conical tip portion of the nozzle member and defining a conical surface positioned centrally within the conical air passage and forming a radially inwardly extending extension of the conical air passage. This arrangement provides a smooth transition from the air passage defined between the nozzle member and the air shroud to the precise location of the exiting bead.

BRIEF DESCRIPTION OF THE DRAWINGS

FIG. 4 is a view corresponding to FIG. 2 with different cross-sectioning;

FIG. 5 is a detail view taken within the circle 5 of FIG. 4;

FIG. 6 is a cross-sectional view taken on line 6-6 of FIG. 4;

FIG. 7 is a detail view taken within the circle 7 of FIG. 6;

DESCRIPTION OF THE PREFERRED EMBODIMENT

The viscous material dispense system of the invention is utilized to dispense a bead of viscous material from a nozzle assembly for application to a suitable surface. The invention is described with reference to the dispensing of a two component viscous material but aspects of the invention may also be applied to the dispensing of a single component viscous material. The materials may include epoxies, silicones, urethanes, acrylics, polyesters, or other viscous materials.

The viscous material dispense system includes a material valve 10 and a nozzle assembly 12.

Figure 1:
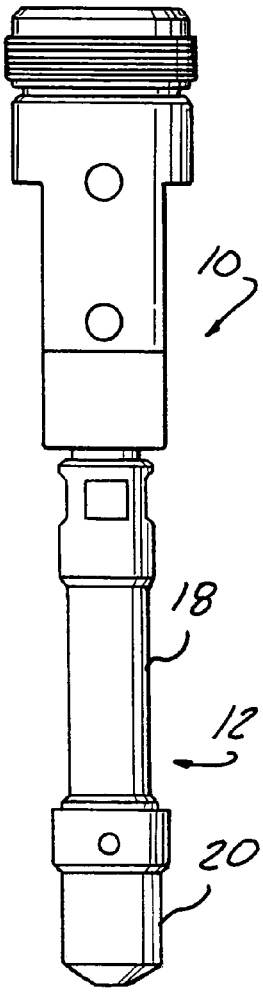
FIG. 1 is a view of a viscous material dispense system according to the invention.
Figure 3:
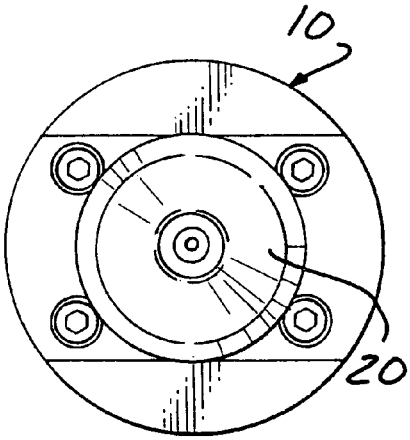
FIG. 3 is a bottom view of the system of FIGS. 1 and 2.
Figure 2:
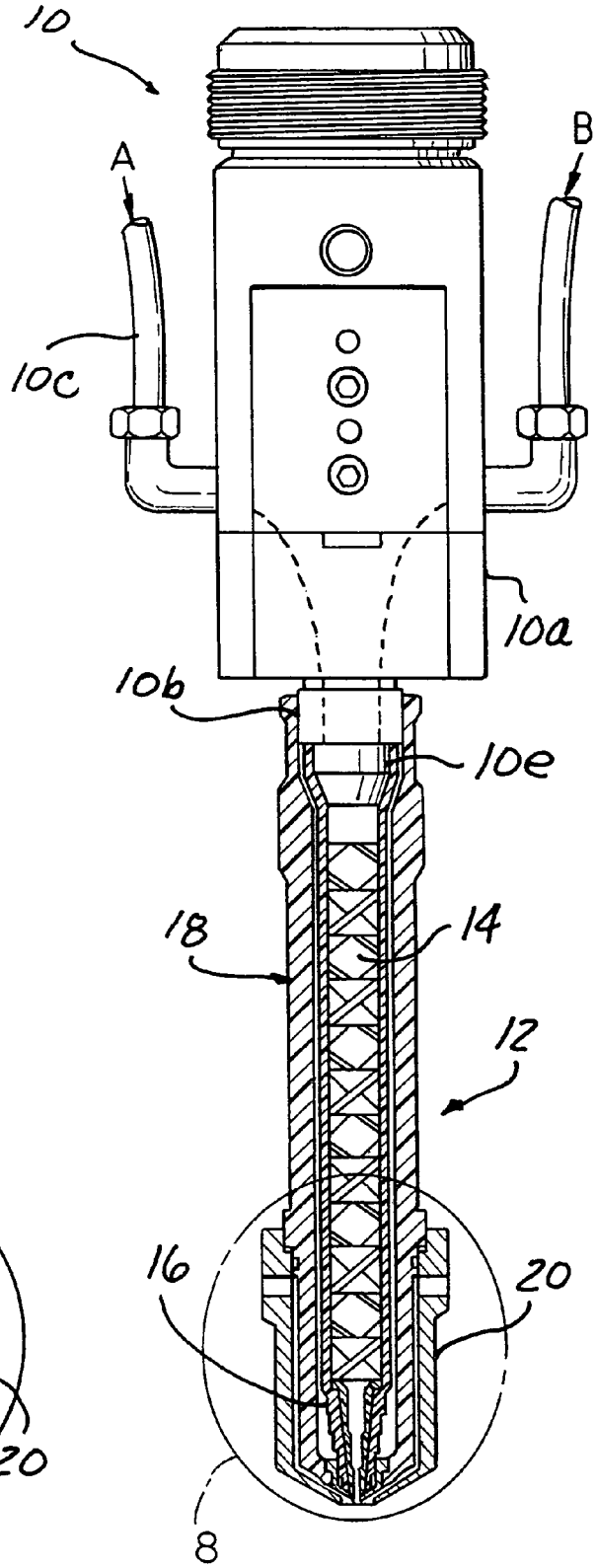
FIG. 2 is a view of the system of FIG. 1 rotated through 90° and partially cross-sectioned.

Material valve 10 (FIGS. 1,3,4) includes a main body portion 10*a* and a discharge or outlet 10*b*. A first synthetic resin material A is delivered via a hose 10*c* to one side face of the main body portion 10*a* and a second synthetic resin B is delivered by a hose 10*d* to an opposite side face of the main body portion 10*a*. It will be understood that in each case the resin emanates from a suitable large volume source and is provided to the hoses 10*c* and 10*d* in pressurized form. The resins A and B move separately through the main body portion of the material valve and separately through the discharge outlet 10*b* of the material valve, and the material valve includes, in known manner, an air actuated valve means to control the movement of the materials A and B through the material valve.

Nozzle assembly 12 includes a mix tube 14, an insert 16, a mixer shroud 18, a dispense tip 22, and an air shroud 20.

Figure 8:
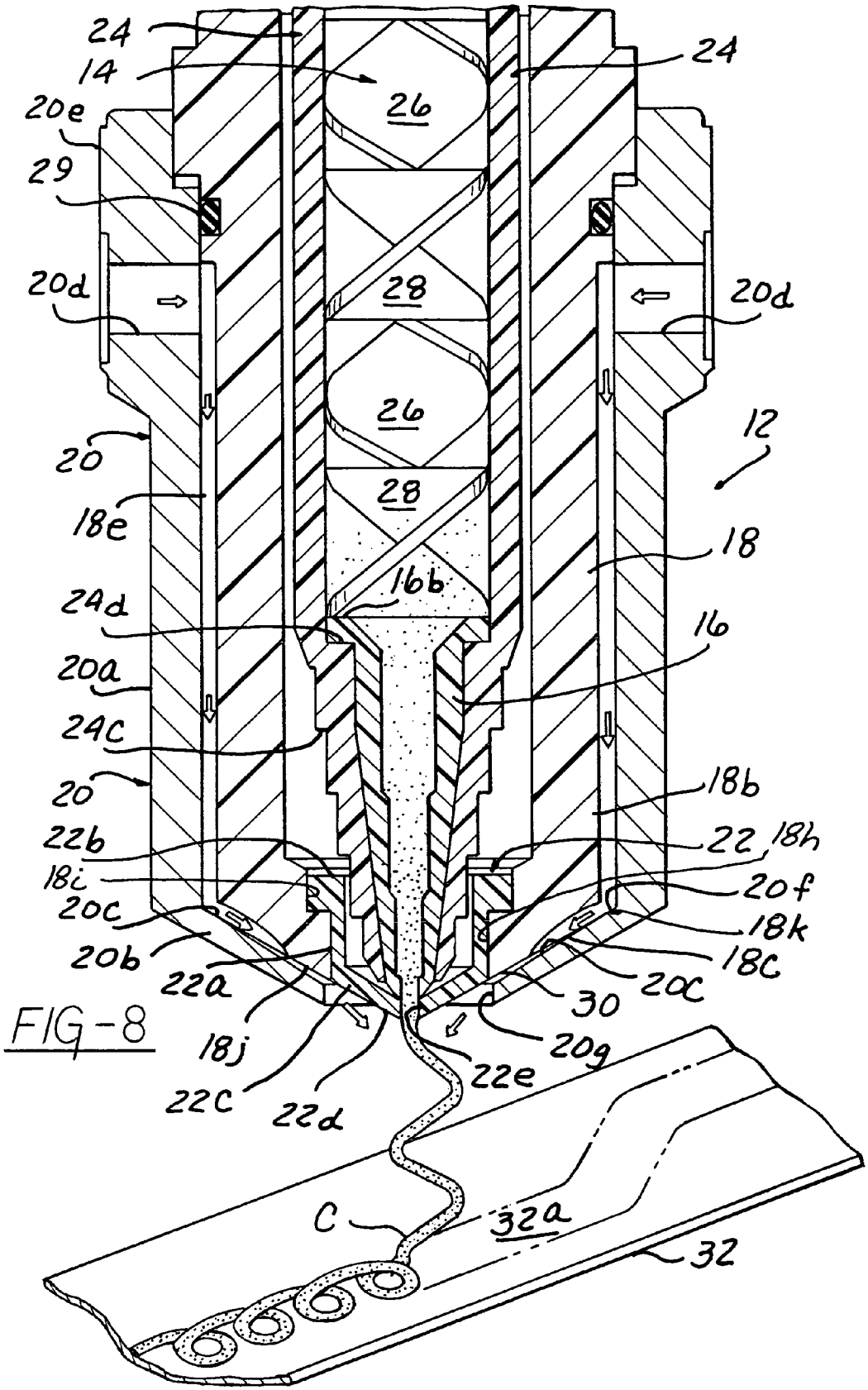
FIG. 8 is an enlarged cross-sectional view taken within the circle 8 of FIG. 2.
Figure 9:
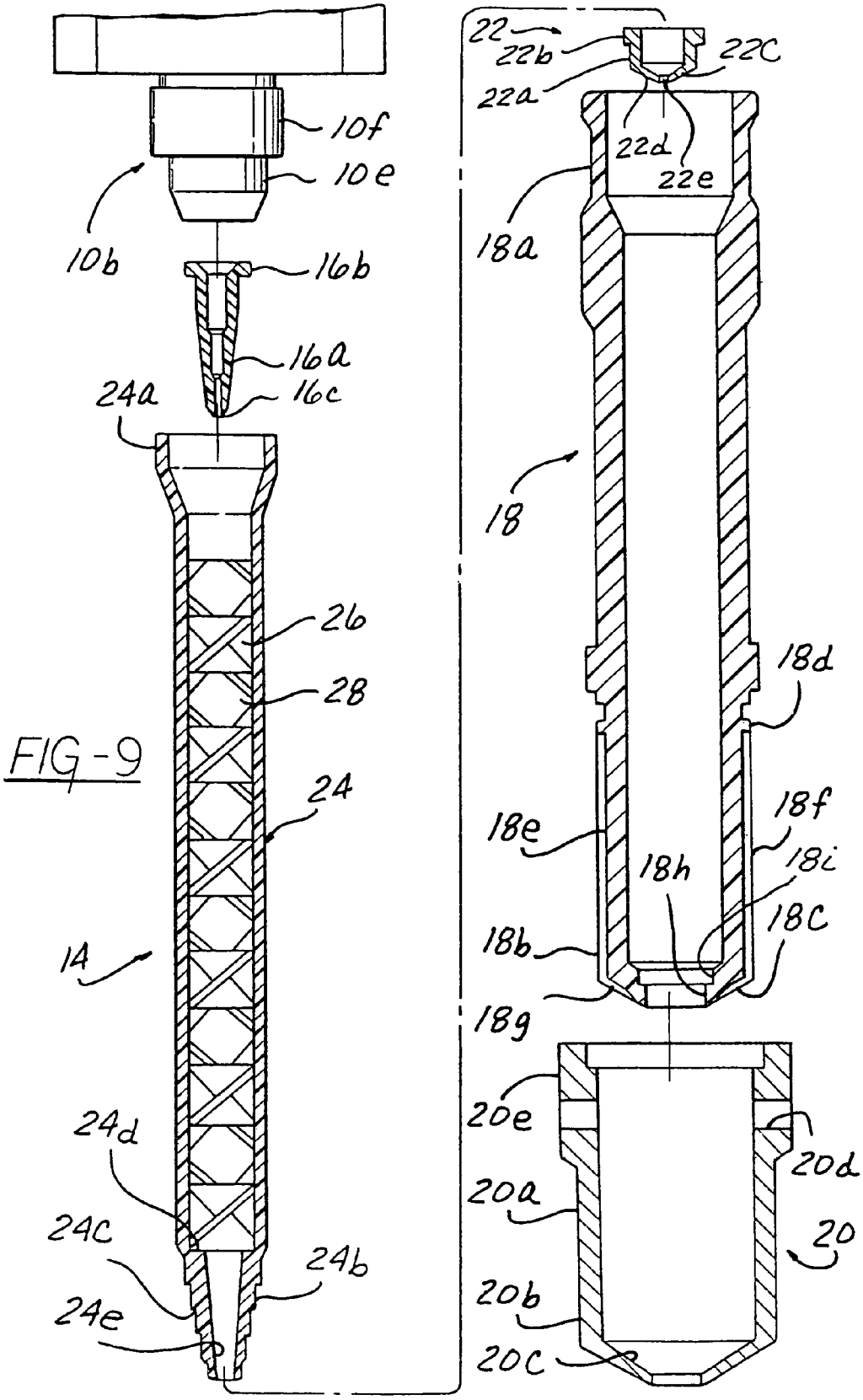
FIG. 9 is an exploded view of the viscous material dispense system.

Mix tube 14 (FIGS. 2,4,8,9) is formed of a suitable plastic material and includes a single piece, tube member 24 (as best seen in FIG. 9), and a plurality of mix elements 26 and 28 comprising alternating left and right hand helical elements positioned in stacked fashion within tube member 24. The upper end of tube member 24 defines a large mouth mounting portion 24*a* and the lower end of the tube member defines a conical nozzle tip portion 24*b* which is stepped at 24*c* to allow the tube member to be selectably clipped at a selected step to selectedly vary the size of the discharge opening of the tube member. Mix tube 14 may comprise, for example, a tube assembly available from ConProTec, Inc. of Salem, N.H. under the tradename "STATOMIX"®.

Dispensing means, such as tip insert or nozzle insert, hereinafter referred to as single piece, insert 16 (as best seen in FIG. 8) is formed of a suitable plastic material and is shaped and configured to fit within the lower end 24*b* of tube member 14 with a conical external surface or main body portion 16*a* of the insert positioned within an inner conical nozzle surface or conical bore 24*e* defined within the lower end 24*b* of the tube member with an outwardly extending annular flange or upper flange portion 16*b* of the insert seating on an inwardly extending annular shoulder 24*d* defined by the tube member at the intersection of the main body portion of the tube member and the lower end 24*b* of the tube member.

Mixer shroud 18 is in the form of a tubular nozzle member, is formed of a suitable plastic material and includes a large mouth upper end mounting portion 18*a*, a lower nozzle tip portion 18*b* defining a conical nozzle surface 18*c*, and an axially extending main body portion 18*d* interconnecting upper end portion 18*a* and nozzle tip portion 18*b*. A plurality of circumferentially spaced, axially extending flutes or grooves 18*e* are provided in the lower end section 18*f* of the main body portion 18*d* and a plurality of circumferentially spaced radially extending flute grooves 18*g* are provided in the conical surface 18*c* of the tip portion. There are a corresponding number of axial flutes and radial flutes and each radial flute communicates at the upper end thereof with the lower end of an axial flute so that the axial and radial flutes combine to provide a plurality of circumferentially spaced grooves extending down the outside of the lower portion of the mixer shroud and then extending radially inwardly along the conical surface 18*c* of the nozzle tip portion of the shroud.

Tubular air shroud 20 is formed of a suitable brass material and includes an annular main body portion 20*a* and a nozzle tip portion 20*b* forming a conical lower nozzle surface 20*c*. A pair of diametrically opposed air inlet apertures 20*d* are provided proximate the upper end 20*e* of the main body portion of the main body portion of the shroud. Air shroud 20 will be seen to be significantly shorter than mixer shroud 18.

Dispense tip 22 is formed of a suitable plastic material and includes a main body portion 22*a* sized to fit telescopically within an aperture 18*h* in the tip portion of the mixer shroud 18, an upper annular flange portion 22*b* sized to seat on an annular seat 18*i* defined at the lower end of the mixer shroud, and a lower conical tip portion 22*c* defining a conical surface 22*d* and a central discharge aperture 22*e*.

In the assembled relation of the various components of the viscous material dispense system, dispense tip 22 is positioned in the aperture 18*h* in the lower end of the mixer shroud 18 with flange portion 22*b* seated on shoulder 18*i* and with the conical lower surface 22*d* of the dispense tip positioned centrally within the conical lower surface 20*c* of the air shroud and forming a radially inwardly extending conical extension of the conical surface 18*c*; insert 16 is positioned in the lower nozzle tip end 24*b* of tube member 24 with flange 16*b* seating on annular shoulder 24*d*; the upper mouth end 24*a* of mix tube 14 is positioned over the lower conical portion 10*e* of material valve discharge outlet 10*b*; mixer shroud 18 is positioned telescopically over mix tube 14 with the upper mouth end 18*a* of the mixer shroud positioned over the upper portion 10*f* of the discharge outlet 10*b* of the material valve and with the lower end or conical nozzle tip portion 24*b* of tube member 24 positioned in the main body portion 22*a* of the dispense tip and the lower end 16*c* of the insert 16 positioned proximate the mouth or discharge opening 22*e* of the dispense tip; and air shroud 20 is positioned telescopically over the lower end 18*f* of the main body portion 18*d* of the mixer shroud with conical surface 20*c* positioned proximate conical surface 18*c* and with air inlets 20*d* positioned proximate the upper ends of the grooves or flutes 18*e*. An annular elastomeric seal 29 is provided between the upper end 20*e* of the air shroud and the conforming annular surface of mixer shroud 18.

Shroud 20 will be seen to coact with the lower section of the main body portion of the mixer shroud to define a plurality of circumferentially spaced axially extending flutes or grooves, as defined by the flutes 18*e* and the confronting inner surface of the air shroud, and a plurality of circumferentially spaced radially inwardly extending flutes or grooves as defined by the flutes 18*g* and the confronting conical surface 20*c* of the air shroud. It will be seen that flutes 18*g* have an arcuate configuration in cross section and do not extend all the way radially inwardly to the central discharge aperture 18*h* of the mixer shroud. Conical lower surface 18*c* of the mixer shroud and the conical surface 20*c* of the air shroud diverge as they extend radially inwardly so that with the annular lower corner 18*k* of the mixer shroud positioned in the annular lower corner 20*f* of the air shroud, a conical passage 30 is defined between the radially inner portion 18*j* of conical surface 18*c* and the confronting portion of conical surface 20*c*. It will be seen that a continuous annular air passage is defined between air inlets 20*d* and the discharge opening 20*g* of the air shroud.

Specifically, a plurality of axially extending and circumferentially spaced air passages extend down the outer periphery of the lower end of the mixer shroud and communicate respectively with a plurality of radially inwardly extending passages defined in the lower conical face of the mixer shroud, whereafter the individual air streams moving downwardly and then radially inwardly converge into an annular air passage 30 to arrive at the discharge opening 20*g* where the air continues to move radially inwardly along the conical surface 22*d* of the dispense tip until it arrives at the discharge opening 22*e* of the dispense tip.

In operation, synthetic resins A and B are supplied continuously by hoses 10*c* and 10*d* to the material valve where they flow individually through the valve and are discharged individually through discharge outlet portion 10*b* into the upper end of the tube member 24. The two-part resins flow downwardly through the tube member 24, engaging successive opposite helixes 26 and 28 and being successively folded over in a compounding manner so that they emerge at the upper end of insert 16 as a totally homogenous mix. The mixed material moves downwardly through the insert 16 and is discharged as a mixed material bead C at the central aperture 22*e* of the dispense tip. As the bead emerges from the aperture 22*e* it is acted upon by the air streams moving downwardly through the flutes 18*e*, radially inwardly through the flutes 18*g*, further radially inwardly through the annular passage 30, and thence along the conical surface 22*d*. As the air streams impinge upon the emerging material bead C they act to impart a swirling movement to the bead so that the bead C is deposited as a compact spiral spray pattern along a surface adhesive path 32*a* on a part 32 in response to relative movement between the nozzle assembly and the part 32. Relative movement between the nozzle assembly and the part 32 may be achieved by movement of the part 32 past the nozzle assembly but more typically will be achieved by movement of the nozzle assembly by an associated robot programmed to move the nozzle assembly along the adhesive path 32*a*. It will be understood that air is delivered to air inlets 20*d* through suitable hoses connected with suitable sources of pressurized air. The air supply pressure may be varied during the course of the dispense cycle to compensate for changes in robot tool tip speed and/or changing height between the discharge orifice and the surface to which the swirled adhesive pattern is applied.

The airstream arrangement of the invention has been found to be capable of imparting a swirl pattern to the exiting bead without the need, as in prior devices, to direct individual air streams precisely tangentially to the exiting bead. Rather, it has found that the individual radially inwardly moving air streams have the effect of imparting the desired swirling movement to the bead without concern for precise impingement of the air streams on tangential surfaces of the bead.

A tubular nozzle member or hollow tubular housing 24 has one end for receiving viscous material for passage through the nozzle member. The hollow tubular housing 24 has a first end and a second end for carrying viscous material therebetween, and a nozzle-retaining surface adjacent one end of the tubular housing. A nozzle insert 16 can be engagable with the nozzle-retaining surface within the tubular housing. The nozzle insert can have a non-linear axially extending inner surface defining a passage therethrough with an aperture of reduced dimension adjacent an outlet end for discharging a viscous material from the tubular housing through the nozzle insert. The nozzle insert 16 can have a first aperture at one end and a second aperture at another end. The first aperture can be larger than the second aperture and can be disposed opposite from the nozzle-retaining surface of the tubular housing. A cylindrical passage portion of the nozzle insert can be located adjacent the second aperture. A static mixer 14 is operably insertable within the hollow tubular housing 24 for trapping the nozzle insert 16 against the nozzle-retaining surface 24*d*. The nozzle insert 16 has an inner surface with a beveled-angular cut adjacent a first end and has a cylindrical surface portion extending longitudinally at least partially between the first end and a second end of the nozzle insert 16. The nozzle insert 16 has an axially extending passage therethrough with an entry portion of the passage having an angular surface in communication with a cylindrical surface extending along at least a portion of the passage.

It will be seen that the invention provides a viscous material dispense system that is simple and inexpensive in construction and that is readily adaptable to accommodate a wide variety of different materials and a wide variety of bead configurations.

Whereas a preferred embodiment of the invention has been illustrated and described in detail it will be apparent that various changes may be made in the disclosed embodiment without departing from the scope or spirit of the invention. For example, although the invention has been illustrated and described with respect to a two component synthetic resin system, it will be apparent that features of the invention may be readily applied to a single component system.

The invention claimed is:

1. An apparatus for dispensing a viscous material comprising:

a tubular nozzle member having one end for receiving viscous material for passage through the nozzle member, a nozzle tip portion having an inwardly extending annular shoulder with an inner conical nozzle surface extending from the annular shoulder toward an opposite end of the nozzle member, and an axially extending main body tubular portion interconnecting the one end and the nozzle tip portion, the tubular nozzle member having an external surface with radially inwardly stepped reductions in dimension approaching an end of the nozzle tip portion providing guides for selectively cutting variable discharge opening sizes; and a nozzle insert having an outwardly extending annular flange adjacent a first end and a conical external surface extending toward a second end, the annular flange of the nozzle insert engageable against the annular shoulder within the tubular nozzle member proximate the nozzle tip portion of the nozzle member, the nozzle insert further having an interchangeable tip insert insertable into the tubular nozzle member, said tip insert having a smaller end aperture than the nozzle tip portion and extending beyond an end of the nozzle tip portion of the tubular nozzle member operative for discharging viscous material.

2. The apparatus of claim 1, wherein the tip insert has an inner surface with an entry point having an angular cut funnel shaped surface portion and a cylindrical surface portion.

* * * * *